US007222781B2

(12) United States Patent
Bogatyrev

(10) Patent No.: US 7,222,781 B2
(45) Date of Patent: May 29, 2007

(54) DEVICE FOR PULLING OUT PACKING MATERIAL FROM A CONTAINER IN ORDER TO BAND A STACK OF BANK NOTES

(76) Inventor: Alexei Borisovich Bogatyrev, d.3, korp.1,kv.50, Sankt-Petersburg, pr. Aviakonstruktorov (RU) 197372

( * ) Notice: Subject to any disclaimer, the term of this patent is extended or adjusted under 35 U.S.C. 154(b) by 362 days.

(21) Appl. No.: 10/508,650

(22) PCT Filed: Sep. 3, 2002

(86) PCT No.: PCT/RU02/00415

§ 371 (c)(1),
(2), (4) Date: Sep. 17, 2004

(87) PCT Pub. No.: WO03/076270

PCT Pub. Date: Sep. 18, 2003

(65) Prior Publication Data

US 2005/0129497 A1 Jun. 16, 2005

(30) Foreign Application Priority Data

Mar. 14, 2002 (RU) ..... 2002106626

(51) Int. Cl.
*G07F 19/00* (2006.01)

(52) U.S. Cl. ..... 235/379; 235/375

(58) Field of Classification Search ..... 235/375, 235/379, 383, 385
See application file for complete search history.

(56) References Cited

U.S. PATENT DOCUMENTS

| | | | | |
|---|---|---|---|---|
| 2,732,063 | A * | 1/1956 | Dedek | 206/410 |
| 3,364,847 | A * | 1/1968 | Marcel | 100/3 |
| 3,842,572 | A * | 10/1974 | Burge | 53/586 |
| 3,896,524 | A * | 7/1975 | Parker | 24/17 B |
| 4,910,944 | A * | 3/1990 | Segalowitz et al. | 53/586 |
| 5,335,484 | A * | 8/1994 | Hain | 53/582 |
| 6,185,905 | B1 * | 2/2001 | Neri | 53/399 |

* cited by examiner

*Primary Examiner*—Karl D. Frech

(57) ABSTRACT

A simple and reliable device is provided which pulls out packing material from a container in order to band a stack of bank notes. The container has an upper lip with an element interacting with the packing material. A vertically reciprocating pickup mechanism is moved down and contacted with an upper surface of a packed band. A suction attaches the upper surface of the packed band and allows the upper surface to be pulled past the upper lip such that when a lower part of said packed band is gripped by retainers that extend from the upper lip, the band is spread out sufficient to insert a rolled up stack of bank notes.

5 Claims, 2 Drawing Sheets

DEVICE FOR PULLING OUT PACKING MATERIAL FROM A CONTAINER IN ORDER TO BAND A STACK OF BANK NOTES

RELATED APPLICATIONS

The present invention is a National Phase Filing of PCT/RU02/00415, having an International Filing Date of 03 Sep. 2002, and contains subject matter that was first described in Russian Federation application having a priority date of 14 Mar. 2002.

TECHNICAL FIELD

The invention relates to packing of stacked bank notes and can be used, for example for banks.

BACKGROUND OF THE INVENTION

Patent RU No 2166466, class B65B27/08 dated 31 May 1999 protects a device for pulling out packing material from a container, comprising a drive mechanism and packing material representing a band with the roll located in the container in the form of a roll holder.

Patent EP 1170215A1, class B65B27/08 dated 04 Jul. 2001 protects a device for pulling out packing material from a container in order to band a stack of bank notes, comprising a container and an element interacting with packing material.

This engineering solution is taken as prototype of the present invention. A disadvantage of said engineering solution is the impossibility to pull out packing material from a container in case if the material is represented as rings formed by way of connecting (adhering) the ends of a flat band, mainly a paper one, said rings being flattened and stacked.

SUMMARY OF THE INVENTION

An object of the invention is to develop a simple and reliable device which makes it possible to efficiently pull out from a container packing material, arranged in the form of flattened and stacked rings, in the form of a flat band, for example a paper one.

According to the invention, the inventive device for pulling out packing material from a container in order to band a stack of bank notes comprises a container and an element interacting with packing material; said container is embodied in the form of a boxlike structure which is open from one side thereof; the internal dimensions of the container correspond to the length and width of the packing material; retainers are arranged on the two free borders of the walls of the container, and the element interacting with the packing material is provided with a pick up mechanism on the end thereof.

The applicant hasn't found any sources of information containing data on engineering solutions, identical to the claimed one. In applicant's opinion, that enables to conclude that the invention conforms to the criterion "novelty" (N).

A substantial new quality of the object which may be obtained when realizing distinguishing features of the claimed invention is the fact that the device enables to pull out from a container by turn packing material arranged in the form of separate flattened and stacked paper rings which spread out in the process of pulling out from a container.

The mentioned condition enables to conclude that the claimed engineering solution conforms to the criterion "inventive step" (IS).

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The device comprises container 1, embodied in the form of a boxlike structure which is open from one side thereof (in the given example, the container is open from the upper part). The internal dimensions of the container 1 (distance between its opposite walls) correspond to the length and width of the packing material for banding a stack of bank notes which is located in container 1; packing material is embodied in the form of rings 2 made of a flat band, in the given example paper band. Rings 2 are flattened and stacked in container 1. Retainers 4 and 5, jutting out in the opening of the container, are arranged opposite each other on the two free borders of the walls of the container from the side of openings 3 of rings 2. Element 6 interacts with the packing material and is provided with a pick up mechanism on the end, performed in the given example in the form of a vacuum element—suction cup 7. The pick up mechanism can be embodied in the form of an element with adhesive material, for example, Scotch tape, etc.

The device functions as follows.

Figure 1:
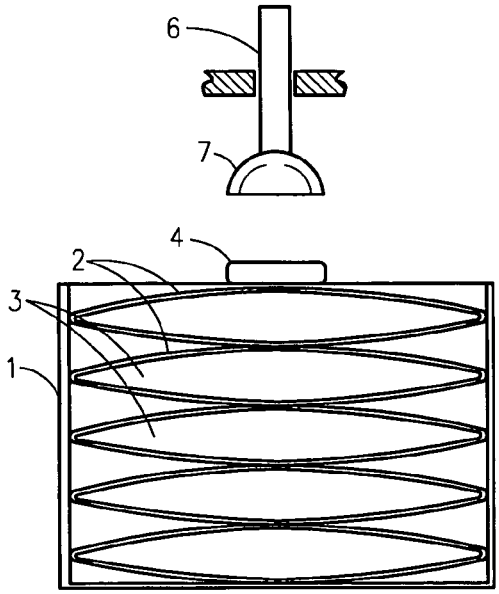
FIG. 1 is a sectional schematic drawing of a Device for Pulling Out Packing Material from a Container in Order to Band a Stack of Bank Notes according to the preferred embodiment of the present invention, shown herein in the initial position.
Figure 2:
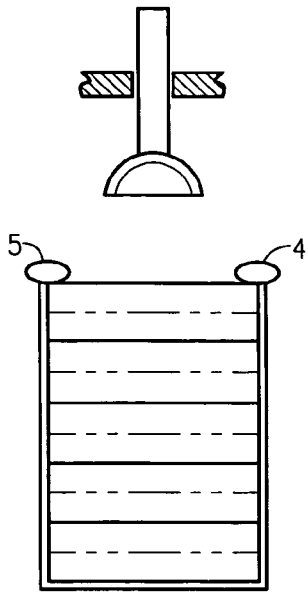
FIG. 2 is a sectional view thereof taken along line I—I in FIG. 1.
Figure 3:
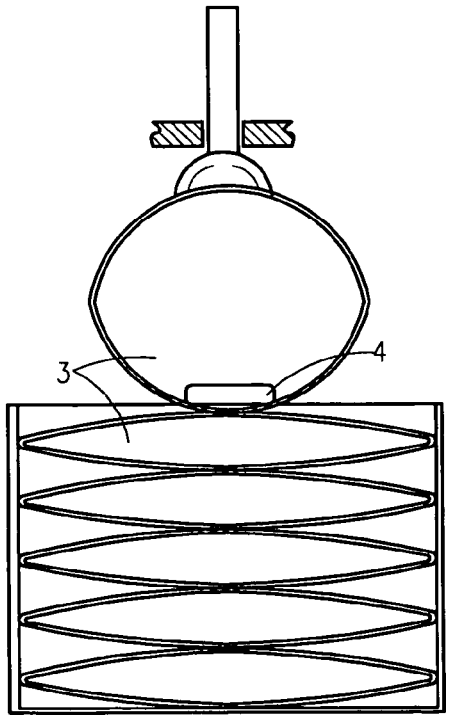
FIG. 3 is a sectional schematic drawing thereof, shown in a working position.
Figure 4:
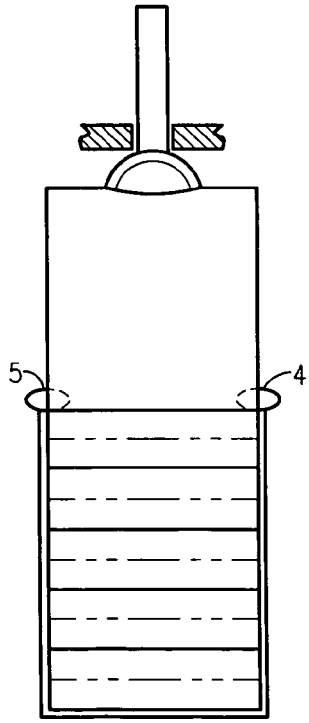
FIG. 4 is a sectional view thereof taken along line II—II in FIG. 3.
Figure 5:
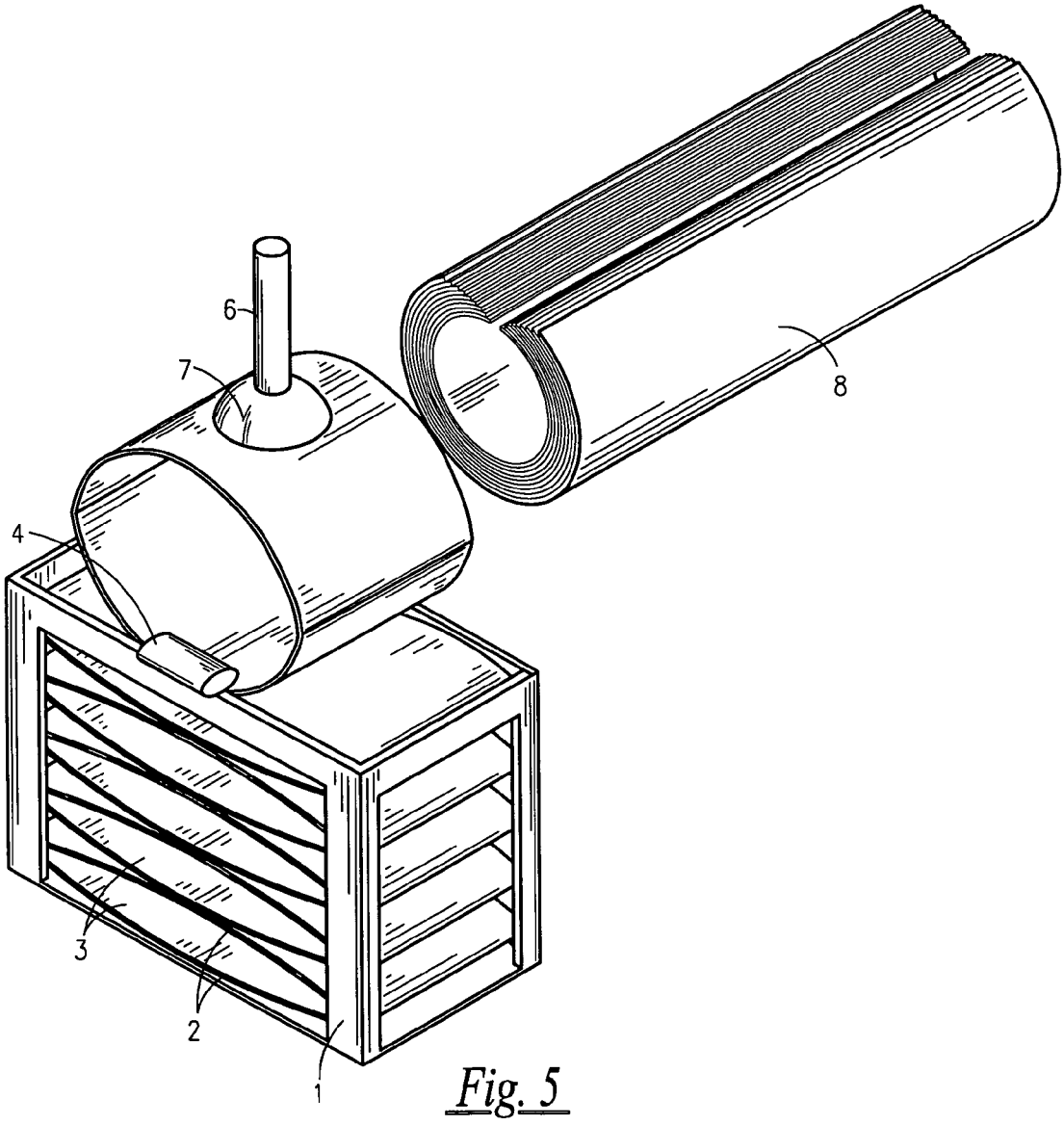
FIG. 5 is an FIG. 5—device in axonometric projection.

Element 6 with suction cup 7 is moved down and contacted with the surface of upper ring 2 of the stack located in container 1; suction cup 7 picks up the upper part of flattened ring 2 thereat. Element 6 with suction cup 7 is put in its initial position thereafter. The upper part of the ring interacts with retainers 4 and 5 and, slightly deforming, passes through the open part of container 1. The lower part of the ring is gripped by retainers 4 and 5, ring 2 spreads out thereat (FIGS. 3, 4). A rolled up stack 8 of bank notes is fed to ring 2, spreading thereafter, and tightly gripped by ring 2; ring 2 is released from retainers 4 and 5 and suction cup 7 thereat.

The cycle is repeated thereafter with the next ring and next stack of bank notes.

INDUSTRIAL APPLICABILITY

Common equipment and inexpensive materials are used for the production of the device for pulling out packing material from a container in order to band a stack of bank notes, which stipulates that the invention corresponds to the criterion "Industrial applicability" (IA).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. Device for pulling out material from a container in order to band a stack of bank notes comprising a container and an element interacting with packing material, wherein the container is embodied in the form of a boxlike structure which is open from one side thereof, the internal dimensions of the container correspond to the length and the width of the packing material, retainers are arranged opposite each other on the upper rims of the two long walls of the container, and the element interacting with the packing material is provided with a pick up mechanism on the end thereof.

2. A device for wrapping bank notes comprises:

a container having four sidewalls circumscribing an inner volume and forming an open upper area;

a plurality of vertically packed bands for wrapping a stack of bank notes, said bands stored within said inner volume and removable from said container through said upper area circumscribed by an upper rim;

a pair of retainers extending into said upper area from said upper rim and arranged opposite each other;

a vertically reciprocating pickup mechanism aligned above said upper area; and suction means terminating said pickup mechanism; wherein when said suctioning means is moved down and contacted with an upper surface of packed band, said upper surface can be pulled past said pair of retainers such that when a lower part of said packed band is gripped by said retainers, said band is spread out sufficient to insert a rolled up stack of bank notes.

3. The device of claim 2, wherein said packing material is embodied in the form of rings made of a flat band that are flattened and stacked in said container.

4. A device for wrapping bank notes comprises:

a container having four sidewalls circumscribing an inner volume and forming an open upper area;

a plurality of vertically packed bands for wrapping a stack of bank notes, said bands stored within said inner volume and removable from said container through said upper area circumscribed by an upper rim;

a pair of retainers extending into said upper area from said upper rim and arranged opposite each other;

a vertically reciprocating pickup mechanism aligned above said upper area; and adhesive means terminating said pickup mechanism;

wherein when said adhesive means is moved down and contacted with an upper surface of packed band, said upper surface can be pulled past said pair of retainers such that when a lower part of said packed band is gripped by said retainers, said band is spread out sufficient to insert a rolled up stack of bank notes.

5. The device of claim 4, wherein said packing material is embodied in the form of rings made of a flat band that are flattened and stacked in said container.

* * * * *